US006371105B1

(12) United States Patent
Merritt

(10) Patent No.: US 6,371,105 B1
(45) Date of Patent: Apr. 16, 2002

(54) STOVE BURNER SHIELD WITH FOLDING SPLASHGUARDS AND LOCKING CONTROL KNOB PROTECTIVE COVER

(76) Inventor: Cecilia Merritt, 2210 Erwin Dr., Euless, TX (US) 76039

( * ) Notice: Subject to any disclaimer, the term of this patent is extended or adjusted under 35 U.S.C. 154(b) by 0 days.

(21) Appl. No.: 09/615,336

(22) Filed: Jul. 12, 2000

(51) Int. Cl.[7] ..... F24C 15/36
(52) U.S. Cl. ..... 126/42; 126/211; 126/214 D
(58) Field of Search ..... 126/211, 214 D, 126/42, 213, 299 C, 39 N

(56) References Cited

U.S. PATENT DOCUMENTS

| | | | | |
|---|---|---|---|---|
| 2,390,234 | A | | 12/1945 | Applebaum |
| 3,319,620 | A | * | 5/1967 | Nazzaro |
| 4,517,955 | A | | 5/1985 | Ehrlich et al. |
| 5,546,928 | A | | 8/1996 | Lewis et al. |
| 5,615,667 | A | * | 4/1997 | Seeley et al. |
| 5,699,900 | A | | 12/1997 | Artis |
| 5,758,636 | A | | 6/1998 | Butrimas et al. |
| 5,842,464 | A | * | 12/1998 | Koch |

FOREIGN PATENT DOCUMENTS

| | | | | |
|---|---|---|---|---|
| FR | 2610704 | * | 12/1988 | ..... 126/42 |
| FR | 2670565 | * | 6/1992 | ..... 126/211 |
| GB | 2213899 | * | 8/1989 | ..... 126/211 |

* cited by examiner

*Primary Examiner*—Carl D. Price
(74) *Attorney, Agent, or Firm*—Michael I. Kroll

(57) ABSTRACT

The present invention 10 discloses a stove burner shield having multiple panels 16, 18, 48, 50 hingedly 42 mounted onto a substantially horizontal frame 12 which is mounted onto a stove top 14 by using fasteners 34 mounted onto downwardly extending flanges 46 spaced apart about the frame 12. When in a raised position, the rear panel 16 and control knob panel 18 act as splash guards. When lowered, the rear panel 16 covers the rear stove burners 52 and the control knob panel 18 covers the control knobs 36. The control knob panel 18 has a release button 32 by means of which it is opened. A hingedly mounted right 50 and left 48 panel are also provided for covering the front stove burners 40.

15 Claims, 7 Drawing Sheets

STOVE BURNER SHIELD WITH FOLDING SPLASHGUARDS AND LOCKING CONTROL KNOB PROTECTIVE COVER

BACKGROUND OF THE INVENTION

1. Field of the Invention

The present invention relates generally to stovetop splashguards and, more specifically, to a stove burner shield having a substantially horizontal framework to secure the apparatus to the stove, pivotable panels attached to the framework to cover the stove burners when not in use that swing open to expose the burners when needed with at least one panel that can be retained in a vertical position to act as a splashguard, and a pivoting control knob protective cover that restricts access to the control knobs when the invention is not in use and swings up to function as a splashguard when in use. The rear panel covers both rear burners and pivots away from the center of the stovetop and locks into place in a substantially vertical position to act as a splashguard against hot oil, grease, or other such elements that might splatter and make a mess. The control knob protective cover could be locked into the closed down position to prevent a child from turning the knobs. The control knob protective cover can also pivot vertically upright and locked to serve as a splashguard against splattering which could make a mess and present a danger to someone in the vicinity of the stove, particularly a child. When locked in the splashguard position the control knob protective cover also acts as a safety barrier to restrict access to the burner area and prevents pots or pans from accidentally sliding or falling off the front area of the stove where injuries are most likely to occur.

2. Description of the Prior Art

There are other splashguard devices designed for stovetops. Typical of these is U.S. Pat. No. 2,390,234 issued to Milton Applebaum on May 31 1943.

Another patent was issued to Conrad P. Ehrlich et al. on May 21 1985, as U.S. Pat. No. 4,517,955. U.S. Pat. No. 5,546,928 was issued to Dan Lewis et. al. on Aug. 20, 1996. Yet another U.S. Pat. No. 5,615,667 was issued to Patricia M. Seeley et. al. on Apr. 1 1997 and still yet another was issued on Jun. 2 1998 to Victor Burimas as U.S. Pat. No. 5,758,636.

U.S. Pat. No. 2,390,234

Inventor: Milton Applebaum

Issued: Dec. 4 1943

A gas stove, the combination with a plurality of burners having manually operable valves controlling the delivery of fuel to the individual burners, valve handles movable through a ninety degree arc and designed to open said valves when in the horizontal position and to close said valves when in vertical position, a cover and burner control attachment unit, said unit being in its entirety pivotally mounted at the rear of said gas stove and being movable between open and closed positions relative to said burners, a locking bar being attached to and being horizontally slidably mounted in said cover and comprising cam means positioned in spaced-apart relation and in alignment with said valve handles, said bar having openings permitting surface portion on said cams to engage with said handles to cause movement of said handles downwardly, said bar having additional means which engage portions of the valves when the locking bar is horizontally slid on the cover after the cover is in the closed position, said cover and burner control attachment being actuated externally of said stove, and latch means engagable within said cover to retain said cam means in alignment with said valve handles and to retain said additional means in engagement with said valve portions to thereby lock said bar and said cover to said stove.

U.S. Pat. No. 4,517,955

Inventor: Conrad P. Ehrlich et. al.

Issued: May 21, 1985

A barrier system for the top of a range along one or more sides thereof comprising for each side a barrier member, a support for detachably attaching the barrier member to interengageable hinge elements on the support and barrier member supporting the barrier member for rotation about an axis parallel to the side of the range to which the barrier member is attached, and interengageable latch members interengageable by rotation of the barrier member to a perpendicular position to lock the barrier member in said perpendicular position and manually disengageable to release the barrier member to permit it to be rotated to a substantially horizontal position.

U.S. Pat. Number 5,546,928

Inventor: Dan Lewis

Issued: Aug. 20, 1996

A stove-mounted grease splatter guard made of a flexible plastic or glass protection portion which attaches to a range via a base portion. The protection portion extends outwardly from the range at an obtuse angle and prevents children from reaching a top surface of the stove. The protection portion also aids in preventing splattering grease from striking the children or reaching the floor on which the stove rests. The base portion is connected to the range with a magnet and hook-and-loop fastener combination.

U.S. Pat. Number 5,615,667

Inventor: Patricia M. Seeley

Issued: Apr. 1, 1997

A substantially U-shaped guard that is attached to pivots that are mounted on the side of the stove. The pivots allow the guard to be moved quickly into or out of position and are detachably secured to the guard so the guard could be removed for cleaning.

U.S. Pat. No. 5,758,636

Inventor: Victor Butrimas

Issued: Jun. 2 1998

The present invention provides for a guard for surrounding the exposed perimeter of the top of a domestic stove. The guard is releasably attached to the stove top such that when it is attached to the stove it securely encloses the burners and pots resting on the burners. The guard prevents the passage of a finger through the guard such that a person is prevented from contacting the burner or pots on the stove when the guard is attached to the stove.

While these stovetop splashguards may be suitable for the purposes for which they were designed, they would not be as suitable for the purposes of the present invention, as hereinafter described.

SUMMARY OF THE PRESENT INVENTION

The present invention discloses a stove burner shield having multiple panels hingedly mounted onto a substantially horizontal frame which is mounted onto a stove top by using fasteners mounted onto downwardly extending flanges spaced apart about the frame. When in a raised position, the rear panel and control knob panel act as splash guards. When lowered, the rear panel covers the rear stove burners and the control knob panel covers the control knobs. The control knob panel has a release button by means of which it is opened. A hingedly mounted right and left panel are also provided for covering the front stove burners.

A primary object of the present invention is to provide a stove burner shield apparatus to cover stovetop burners having panels to protect the burners when not in use that are pivotally attached to a frame that is removably secured to a stovetop.

Another object of the present invention is to provide a stove burner shield with pivoting panels wherein the panels cover the burners when in the inoperative horizontal position and selectively pivot to expose the burners that are to be used.

Yet another object of the present invention is to provide a stove burner shield with pivoting panels having a semi-cylindrical control knob protective cover that is pivotally connected longitudinally to the anterior edge of the framework in a manner and configuration that will allow the control knob protective cover to encompass the control knobs when in the down position thereby restricting access and inadvertent activation of the burners by a child or through incidental contact.

Still yet another object of the present invention is to provide a stove burner shield with pivoting panels having a control knob protective cover that can be locked into position to prevent access to the control knobs.

Yet another object of the present invention is to provide a stove burner shield with pivoting panels having a control knob protective cover that can swing upright and lock into place to form a splashguard to protect the user and the control knobs from splattering material.

Another object of the present invention is to provide a stove burner shield with pivoting panels having a control knob protective cover that when locked into place as a splashguard acts also as a barrier to restrict access to the burner area and to prevent pots and pans from sliding or falling off of the stovetop.

Still another object of the present invention is to provide a stove burner shield with pivoting panels having a control knob protective cover that automatically locks once in the fully closed or fully open positions and must then be actively released prior to subsequent movement.

A further object of the present invention is to provide a stove burner shield with pivoting panels and control knob protective cover that is manufactured of a heat-resistant material with a non-stick surface.

Additional objects of the present invention will appear as the description proceeds.

The present invention overcomes the shortcomings of the prior art by providing a stove burner shield that is removably secured to the stove and has pivoting panels with at least one panel functioning as a splashguard when in the open position and also having a control knob protective cover that must be actively released to expose the control knobs and acts as a splashguard/barrier when locked into the open position.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
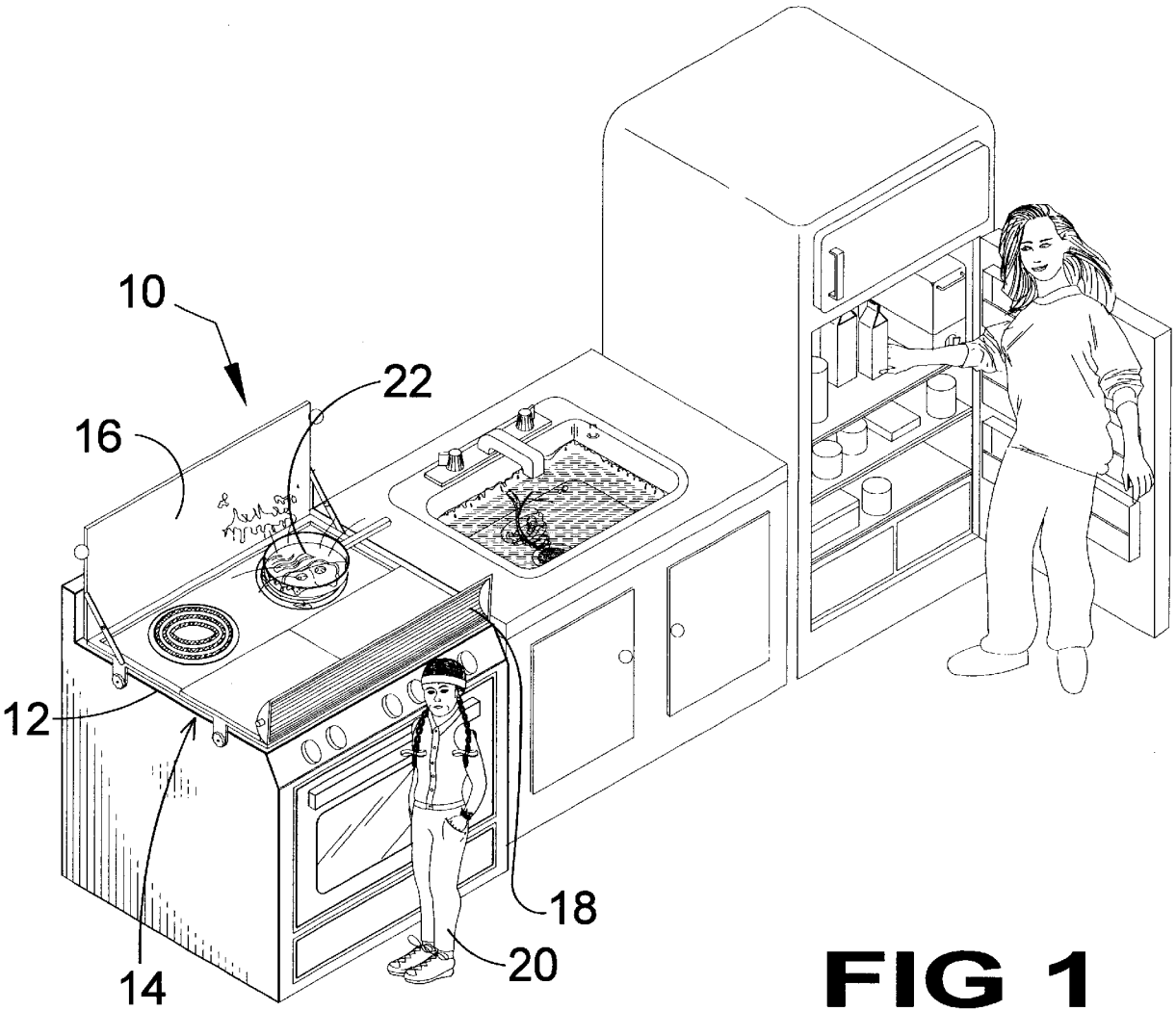
FIG. 1 is a perspective view of the present invention in use showing the stove burner shield secured to the stove with both the rear panel and burner control protector panel raised and locked into place to function as splashguards.

With regard to reference numerals used, the following numbering is used the drawings.

10 present invention
12 frame
14 stove top
15 stove
16 rear panel
18 control knob protector panel
20 child
22 frying pan
23 residue
24 non-stick coating
26 front panels
28 locking mechanism
30 handle

32 release buttons
34 fasteners
36 store control knobs
38 direction arrow
40 front burner
42 hinges
44 peripheral edges
46 flange
48 left panel
50 right panel
52 burners

DESCRIPTION OF THE PREFERRED EMBODIMENT(S)

In order that the invention may be more fully understood, it will now be described, by way of example, with reference to the accompanying drawings in which FIGS. 1 through 7 illustrate the present invention being a spash guard and control knob protective cover for a stove.

Turning to FIG. 1, shown therein is a perspective view of the present invention 10 in use showing the stove burner shield 10, with frame 12 secured to the stove top 14 with both the rear panel 16 and concave burner control knob protector panel 18 raised and locked into place to function as splashguards. The stove top 14 has multiple burners thereon and the control knobs are positioned on its front. Also shown is a child 20 which is protected by the raised panel 18 from hot grease from the frying pan 22.

Figure 2:
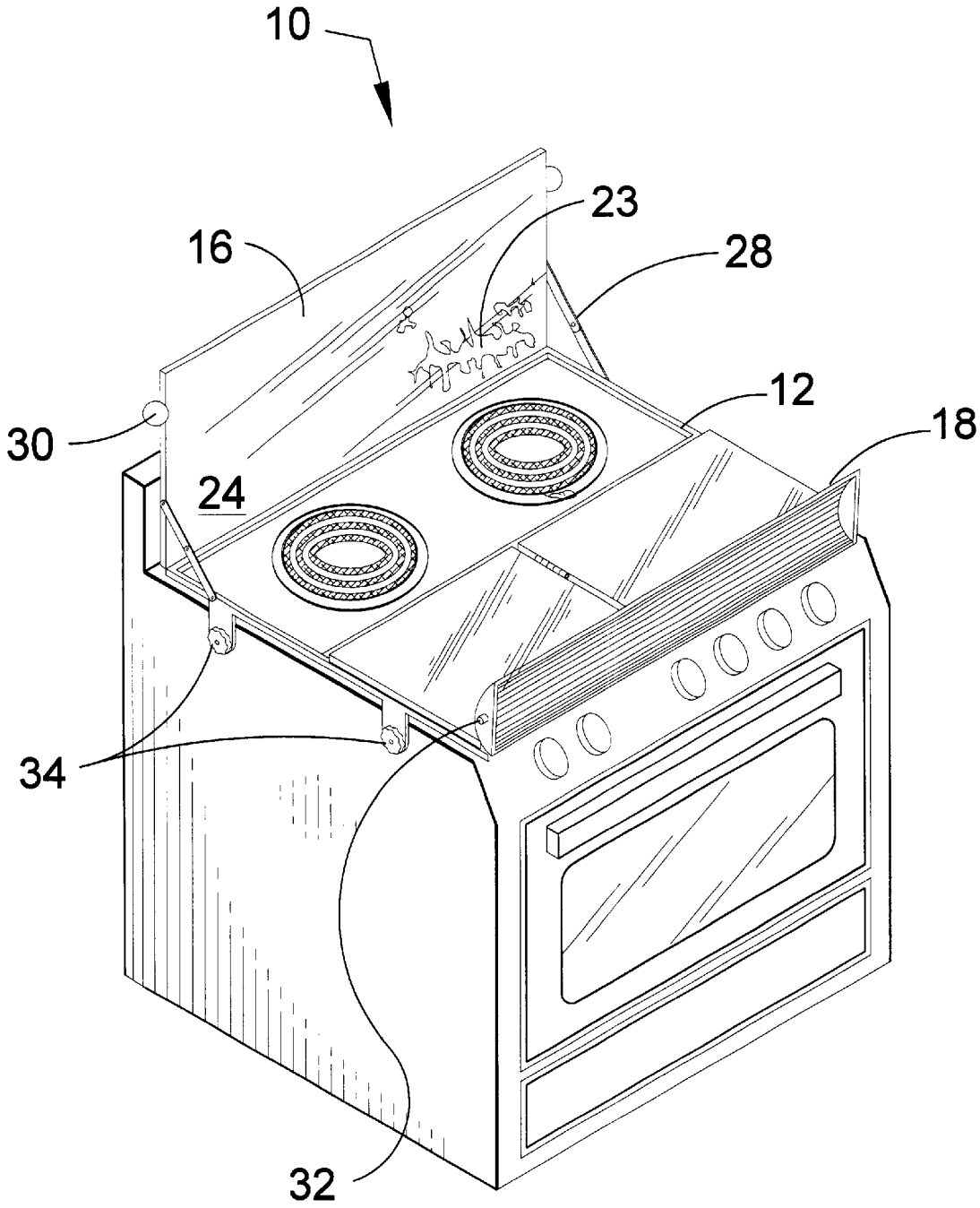
FIG. 2 is a detailed perspective view of the present invention as shown in FIG. 1 with the frying pan removed and the residue from the splattered grease ready for cleaning. The non-stick coating on the panel could be cleaned in place or the panel can easily be removed from the frame for a more thorough scrubbing.

Turning to FIG. 2, shown therein is a detailed perspective view of the present invention 10 as shown in FIG. 1 with the frying pan removed and the residue 23 from the splattered grease ready for cleaning. The non-stick coating 24 on the panel 16 could be cleaned in place or the panel can easily be removed from the frame 12 having multiple openings therein for a more thorough scrubbing. The frame 12 has front, rear and two side edges. Also shown are the handle 30 and locking mechanism 28 for the rear panel 16 along with the concave control knob cover 18 with release button or latch 32 and screw down fasteners 34 for the present invention 10. Fasteners 34 attach the frame 12 to the stove.

Figure 3:
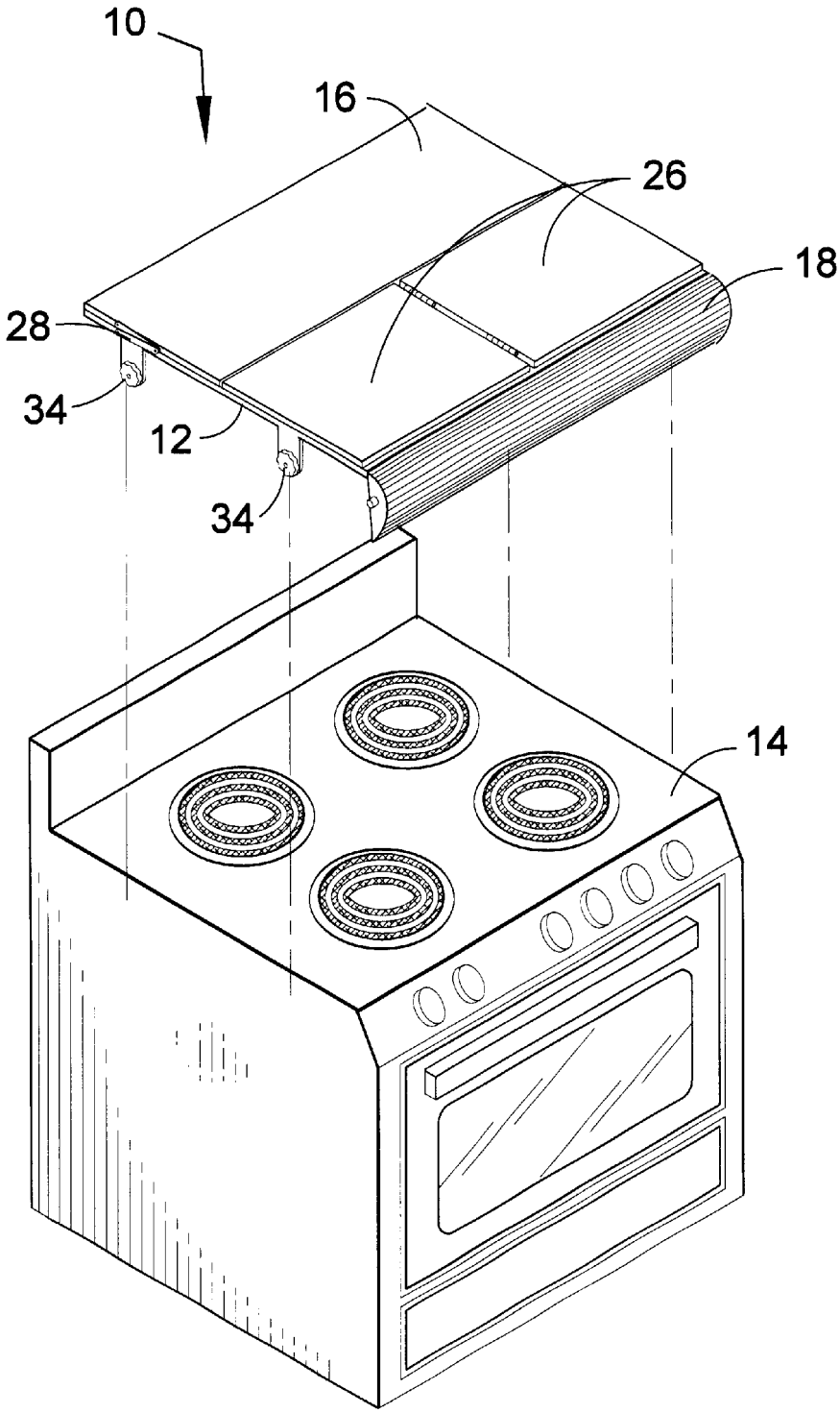
FIG. 3 is an exploded perspective view of the present invention with center lines illustrating the placement of the stove burner shield relative to the stove.

Turning to FIG. 3, shown therein is an exploded perspective view of the present invention 10 with center lines illustrating the placement of the stove burner shield 10 relative to the stove top 14. Also shown are the frame 12, rear panel 16 folded down, rear panel locking mechanism 28, fasteners 34, front panels 26, and control knob cover 18 folded down to cover the stove control knobs 36.

Figure 4:
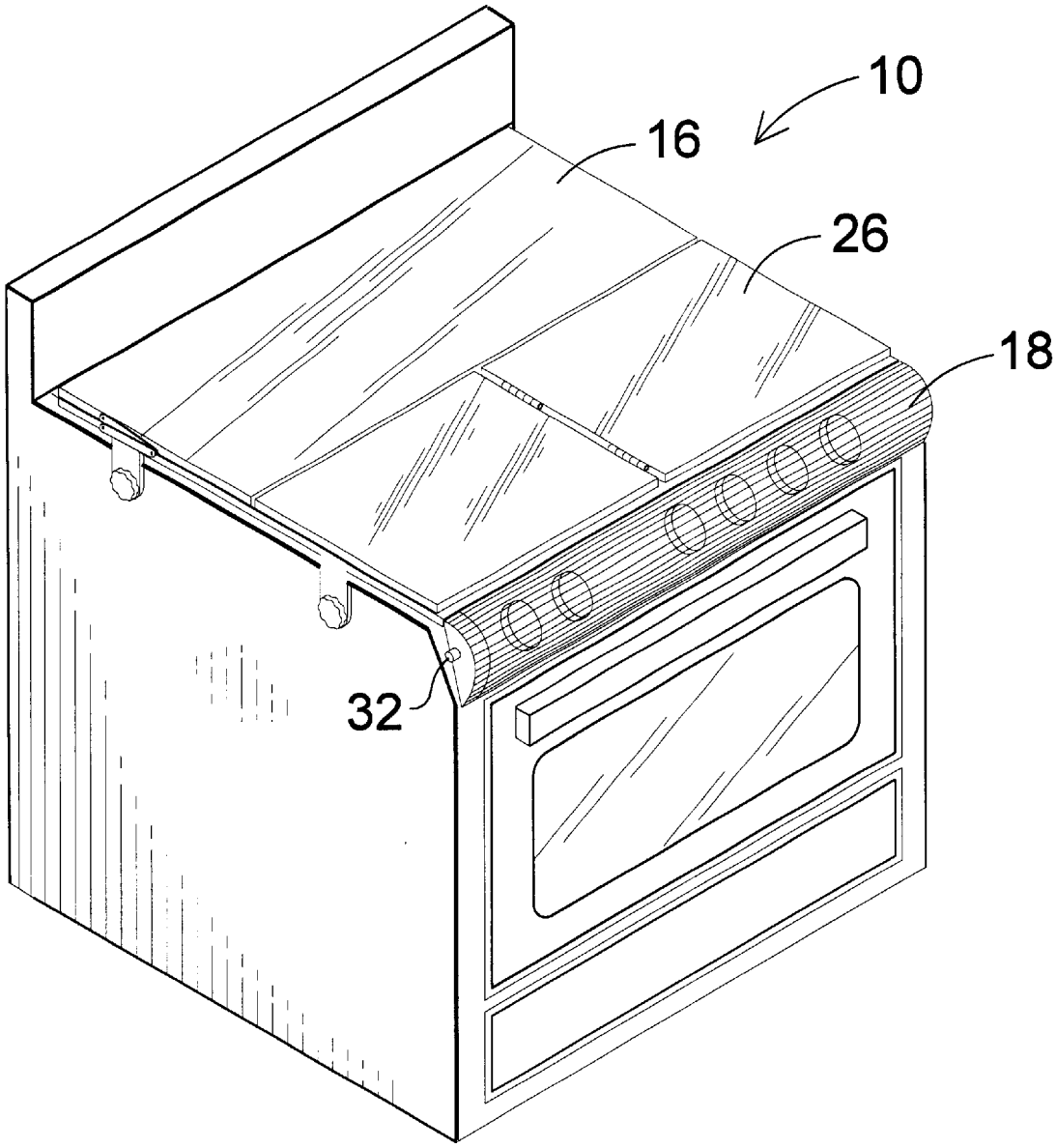
FIG. 4 is a perspective view of the present invention showing all panels in the closed horizontal position. The control knob protective cover is locked in place and cannot be moved until the release button is depressed.

Turning to FIG. 4, shown therein is a perspective view of the present invention 10 showing all panels 16, 18, 26 in the closed horizontal position. The control knob protective cover 18 is locked in place and cannot be moved until the release button 32 is depressed.

Figure 5:
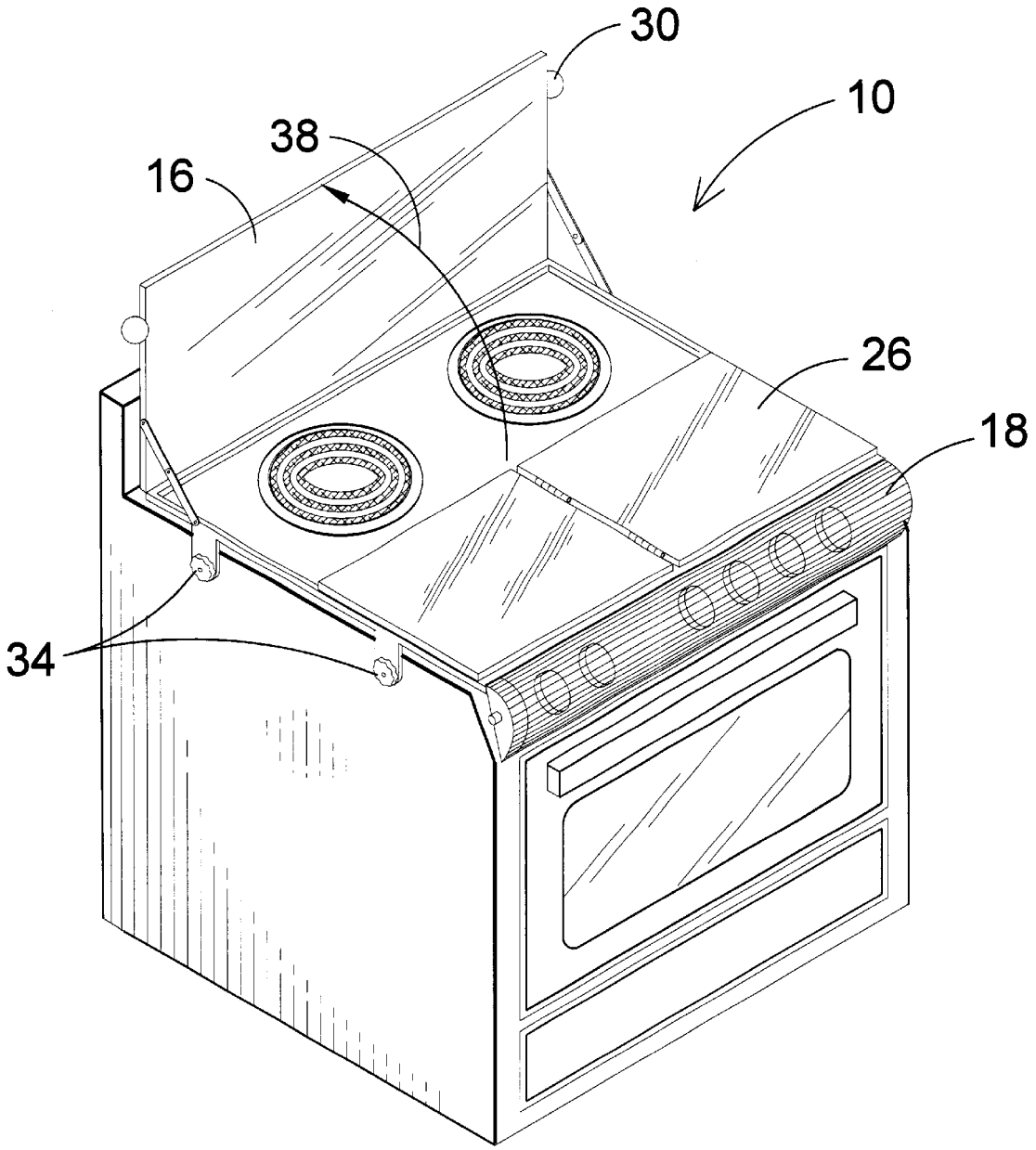
FIG. 5 is a perspective view of the present invention showing the pivoting action of the rear splashguard panel.

Turning to FIG. 5, shown therein is a perspective view of the present invention 10 showing the pivoting action with direction arrow 38 of the rear splashguard panel 16. Other elements previously disclosed are also shown.

Figure 6:
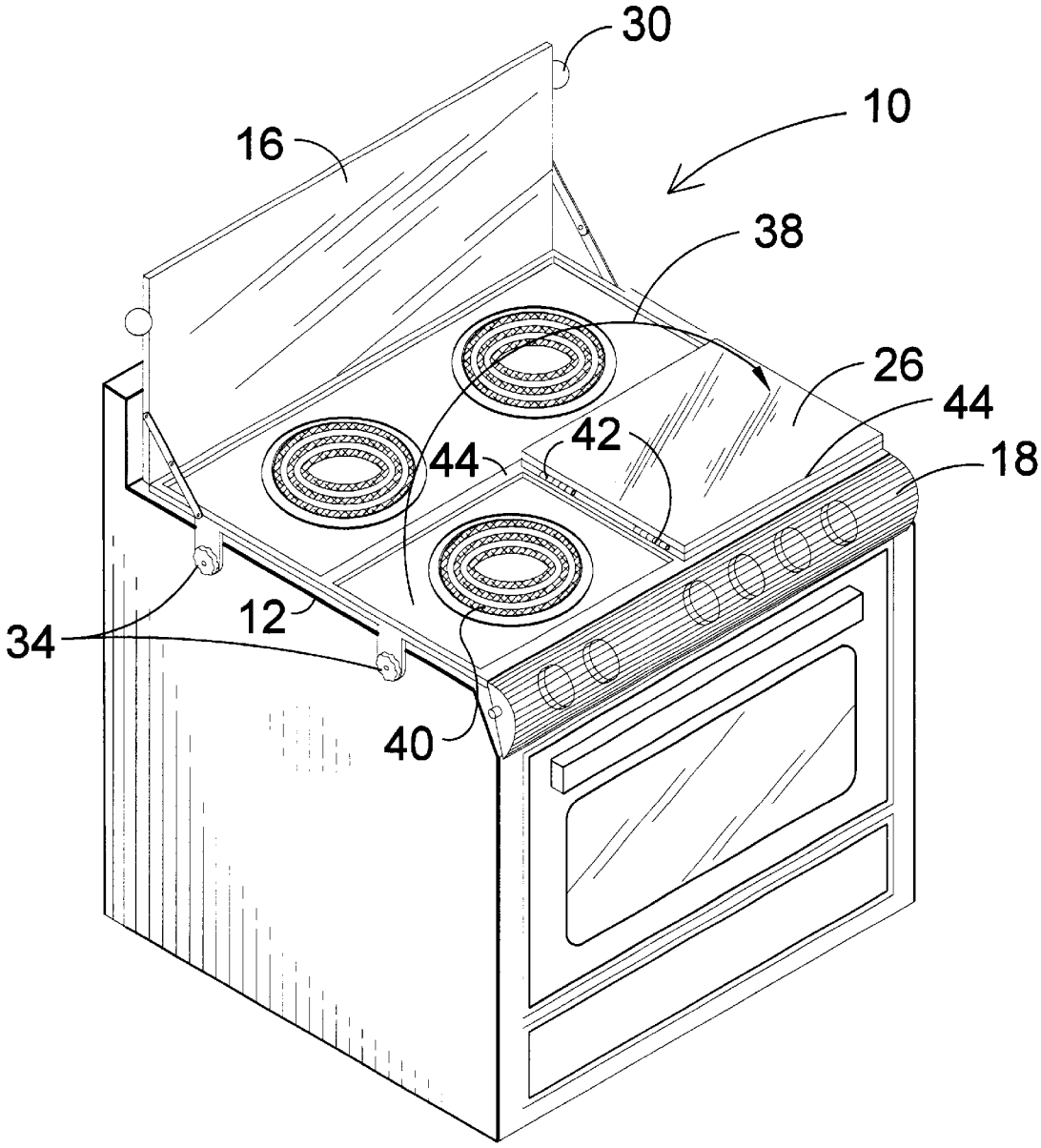
FIG. 6 is a perspective view of the present invention showing the pivoting action of a panel covering a front burner. This configuration demonstrates centrally hinged front panels but the unit may be adapted to locate the hinges on the peripheral edges of the frame to permit access to all burners and to utilize the panels as side splashguards similar to the rear panel.

Turning to FIG. 6, shown therein is a perspective view of the present invention 10 showing the pivoting action 38 of a front panel 26 covering a front burner 40. This configuration demonstrates the centrally hinged 42 front 26 but the unit may be adapted to locate the hinges on the peripheral edges 44 of the frame 12 to permit access to all burners and to utilize the panels as side splashguards similar to the rear panel 16. Other elements previously disclosed are also shown.

Figure 7:
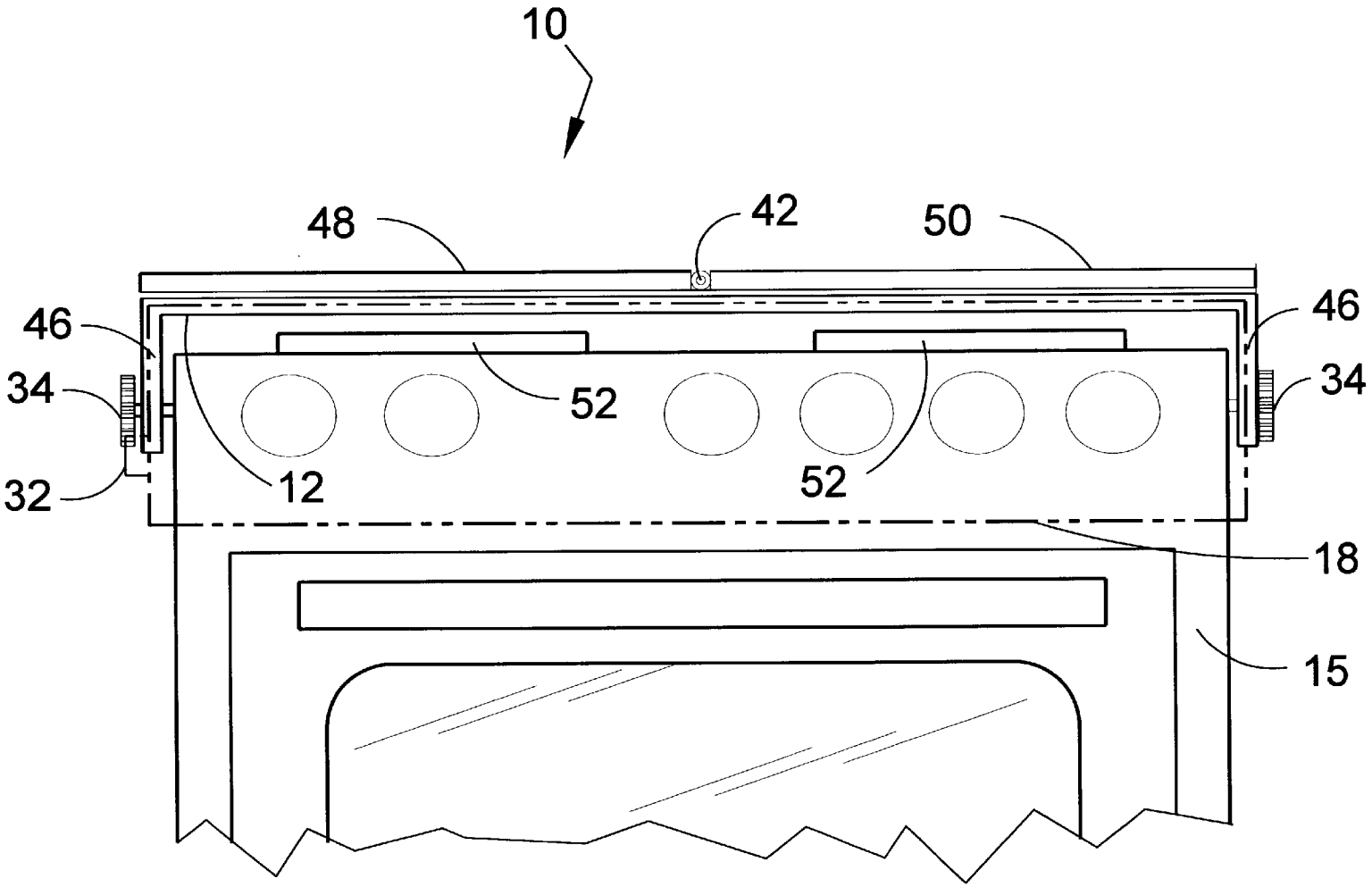
FIG. 7 is a front view of the present invention with a section of the stove broken away and the control knob protective cover shown in phantom line.

Turning to FIG. 7, shown therein is a front view of the present invention 10 with a section of the stove 15 broken away and the control knob protective cover 18 shown in phantom line. Flanges 46 downwardly extend from frame 12 which flanges have apertures therein through which threaded fasteners 34 with knobs extend for attaching the present invention 10 to the stove 15. The left 48 and right 50 burner panels with burners 52, hinge 42, and release button 32 are also shown.

I claim:

1. An apparatus for covering the top of a stove, the stove having multiple burners disposed on its top, the stove having control knobs disposed on its front, comprising:

a) a generally horizontally disposed frame, said frame complementarily sized to fit on the top of the stove, said frame having a front edge, a rear edge, and two side edges, said frame having multiple openings therein through which the stove burners are accessed;

b) said frame having at least one cross member connecting opposite sides of said frame;

c) means for attaching said frame to the top of the stove;

d) a plurality of planar panels disposed onto said frame, said planar panels covering said openings when in the horizontal position;

e) a first means for hingedly connecting said panels to said frame;

f) a concave panel disposed longitudinally across the front of the stove, said concave panel sized to cover the control knobs on the front of the stove; and, g) a second means for hingedly connecting said concave panel to said frame.

2. The apparatus of claim 1, said means for attaching said frame to the top of the stove further comprises multiple downwardly extending flanges disposed onto the periphery of said frame.

3. The apparatus of claim 2, wherein said flanges communicate with the periphery of said stove.

4. The apparatus of claim 3, said flanges having apertures therein, said apertures for receiving multiple fastener means whereby said frame is connected to the top of the stove.

5. The apparatus of claim 4, further comprising said apertures being threaded and said fasteners being threaded.

6. The apparatus of claim 5, further comprising said threaded apertures mating with said threaded fasteners said frame thereby being connected to the top of the stove.

7. The apparatus of claim 1, wherein said planar panels are disposed in the horizontal plane when closed.

8. The apparatus of claim 7, further comprising a rear panel disposed longitudinally across the rear of the stove, said rear panel covering the two rear stove burners.

9. The apparatus of claim 8, further comprising a locking mechanism for holding said rear panels in an upright position, said panels acting as a splashguard when in the upright position.

10. The apparatus of claim 9, further comprising a left front panel and a right front panel for covering the two front stove burners.

11. The apparatus of claim 8, further comprising at least one handle disposed on said rear panel, said handle for lifting said rear panel.

12. The apparatus of claim 1, wherein said second means for hingedly connecting said concave panel is longitudinally disposed on the front edge of said frame.

13. The apparatus of claim 12, wherein said concave panel is made of transparent material.

14. The apparatus of claim 12, further comprising means for a latch disposed on said concave panel whereby said panel can be locked in the up or down position.

15. The apparatus of claim 1, further comprising a non-stick coating on said panels.

* * * * *